US006077455A

United States Patent [19]

Bloch et al.

[11] Patent Number: 6,077,455

[45] **Date of Patent: *Jun. 20, 2000**

[54] AUTOMATIC TRANSMISSION FLUID OF IMPROVED VISCOMETRIC PROPERTIES

[75] Inventors: Ricardo Alfredo Bloch, Scotch Plains; Raymond F. Watts, Long Valley; Christopher W. Cornish, Cranbury, all of N.J.

[73] Assignee: Exxon Chemical Patents Inc, Linden, N.J.

[ * ] Notice: This patent issued on a continued prosecution application filed under 37 CFR 1.53(d), and is subject to the twenty year patent term provisions of 35 U.S.C. 154(a)(2).

[21] Appl. No.: 09/006,574

[22] Filed: Jan. 13, 1998

Related U.S. Application Data

[63] Continuation-in-part of application No. 08/880,345, Jun. 23, 1997, which is a continuation of application No. 08/522,809, Sep. 1, 1995, Pat. No. 5,641,733, which is a continuation-in-part of application No. 08/502,954, Jul. 17, 1995, Pat. No. 5,641,732.

[51] Int. Cl.[7] ..... C09K 5/00; C10M 133/16; C10M 145/14

[52] U.S. Cl. ..... 252/77; 252/79; 508/232; 508/469; 508/476; 508/554; 508/559

[58] Field of Search ..... 252/77, 79; 508/232, 508/188, 476, 469, 554, 559

[56] References Cited

U.S. PATENT DOCUMENTS

| | | | |
|---|---|---|---|
| 5,064,546 | 11/1991 | Dasai | 408/436 |
| 5,372,735 | 12/1994 | Ohtani et al. | 508/562 |
| 5,387,346 | 2/1995 | Hartley et al. | 508/232 |
| 5,578,236 | 11/1996 | Srinivasan et al. | 508/188 |
| 5,641,732 | 6/1997 | Bloch et al. | 508/232 |
| 5,641,733 | 6/1997 | Bloch et al. | 508/232 |
| 5,646,099 | 7/1997 | Watts et al. | 508/232 |

FOREIGN PATENT DOCUMENTS

| | | | |
|---|---|---|---|
| 2095972 A1 | 11/1993 | Canada | C10M 145/14 |
| 0 721 978 A2 | 7/1996 | European Pat. Off. | C10M 169/04 |

*Primary Examiner*—Jacqueline V. Howard
*Assistant Examiner*—Cephia D. Toomer

[57] ABSTRACT

This invention provides compositions and methods for producing automatic transmission fluids capable of improved viscometric properties and capable of achieving −40° C. Brookfield viscosities not greater than 18,000 centipoise using natural lubricating oils.

13 Claims, 2 Drawing Sheets

VISCOSITY LOSS TRAPEZOID

VISCOSITY LOSS TRAPEZOID

VISCOSITY LOSS TRAPEZOID

AUTOMATIC TRANSMISSION FLUID OF IMPROVED VISCOMETRIC PROPERTIES

RELATED APPLICATION

This application is a Rule 1.53 continuation-in-part of U.S. Ser. No. 880,345, filed Jun. 23, 1997 pending, which is a Rule 60 continuation of U.S. Ser. No. 08/522,809, filed Sep. 1, 1995, now U.S. Pat. No. 5,641,733, which is a continuation-in-part of patent application, U.S. Ser. No. 08/502,954, filed Jul. 17, 1995, now U.S. Pat. No. 5,641,732.

BACKGROUND OF THE INVENTION

This invention relates to a composition and a method of improving the properties of power transmitting fluids, particularly to obtaining automatic transmission fluids of improved viscosity control.

Automatic transmissions continue to become more sophisticated in design as vehicle technology advances. These design changes result from the need to improve vehicle operability, reliability, and fuel economy. Vehicle manufacturers worldwide are increasing vehicle warranty periods and service intervals on the vehicles. This means that the automatic transmission, and the automatic transmission fluid (ATF), must be designed to operate reliably without maintenance for longer periods of time. In the case of the fluid, this means longer drain intervals. To improve vehicle operability, especially at low temperature, manufacturers have imposed strict requirements for fluid viscosity at −40° C. To cope with longer drain intervals and more severe operating conditions, manufacturers have increased the requirements for oxidation resistance of the ATF, and increased the amount of wear protection that the fluid must provide for the transmission. To improve the fuel economy of the vehicle and reduce energy loss in the torque converter, manufacturers employ sliding torque converter clutches, which require very precise control of fluid frictional properties. One common element in the quest for better reliability, longer service life, and better transmission control is the viscometric properties of the fluid.

It is well known that lowering the viscosity of an ATF at low temperatures (e.g., −40° C.) will result in improved operability of the transmission at low ambient temperatures, that increasing the amount of antiwear additives in the ATF will result in more wear protection, and that better friction control can be obtained by judicious choice of friction modifiers. However, applicants have now found that by proper selection of viscosity modifier molecular weight, the low temperature operability, service life, and friction control of the ATF, can be improved simultaneously.

Correct choice of the viscosity modifier molecular weight allows the fluid to meet the high temperature viscosity requirements imposed by the manufacturer, while also allowing the fluid to meet rigorous low temperature viscosity limits. High temperature viscosity is also known to control wear in hydrodynamic and elastohydrodynamic wear regimes. High initial viscosity, at high temperatures (e.g., 100° C. and 150° C.), at both low (i.e., 1 to 200 $sec.^{-1}$) and high shear rates ($1\times10^6$ $sec.^{-1}$) helps to control this wear. Equally important is the fluid's ability to maintain this high level of viscosity under both high and low shear rates, even after use. A high initial viscosity at high temperatures and low shear rates are important to transmission operability as well. High viscosity at high temperature and low shear rate controls fluid leakage at high pressures. This is not leakage from the transmission itself, but leakage at high pressures (e.g., 830 kPa (120 psi)) around seals and valves in the transmission control system. No matter how sophisticated the electronic control of the transmission, if the fluid is leaking under pressure in the valve body, the transmission will not function properly. This is particularly important in transmissions using sliding torque converter clutches since control of these devices is accomplished by minute fluctuations in clutch actuating pressure.

By careful selection of the molecular weight of the viscosity modifier, the aforementioned properties of the ATF can be improved simultaneously. If the molecular weight of the viscosity modifier is too low, too much will be needed to produce the required viscosity at high temperatures. This is not only uneconomical, but will eventually cause elevation of the viscosity at low temperature making it difficult or impossible to meet lower −40° C. Brookfield viscosities. If the molecular weight of the viscosity modifier is too high, it will degrade by both mechanical shear and oxidation during service such that the high temperature viscosity contributed by the polymer will be lost, making the transmission vulnerable to wear and internal leakage. However, adding sufficient high molecular weight polymer to give the required "used oil viscosity" causes elevation of the low temperature (−40° C.) Brookfield viscosity of the fluid, possibly exceeding the specified maximum viscosity.

Prior attempts at providing an ATF simultaneously displaying an acceptable used oil viscosity and Brookfield viscosity all required the use of a synthetic lubricating oil component, particularly a poly-alpha olefin lubricant component. (See U.S. Pat. Nos. 5,641,732; 5,641,733 and 5,578,238). However, synthetic lubricating oils are far more expensive than natural lubricating oils. Therefore, from a commercial standpoint, it would be highly advantageous to provide an ATF capable of achieving acceptable used oil viscosity and Brookfield viscosity in use, which ATF contains substantially no, preferably no, synthetic lubricating oil component.

ATF's provide very precise frictional characteristics to the transmissions in which they are used. To meet friction requirements, ATF's must contain a friction modifier.

SUMMARY OF THE INVENTION

This invention relates to an automatic transmission fluid composition comprising:

(a) a major amount of a lubricating oil consisting essentially of a natural lubricating oil or blend of natural lubricating oils having a kinematic viscosity of at least 3 $mm^2/s$ (cSt) at 100° C.;

(b) a viscosity modifier having a molecular weight no greater than about 175,000 atomic mass units; and (c) from about 0.01 to about 5 weight % of a friction modifier; providing that the composition has a −40° C. Brookfield viscosity no greater than 18,000 centipoise and the difference between new and sheared viscosity of the composition is no greater than 0.30 centipoise when measured at a temperature of 150° C. and a shear rate of $2\times10^2$ $sec.^{-1}$.

This invention also concerns a method for providing a shear-stable automatic transmission fluid.

DETAILED DESCRIPTION OF A PREFERRED EMBODIMENT

Lubricating Oils

Figure 1:
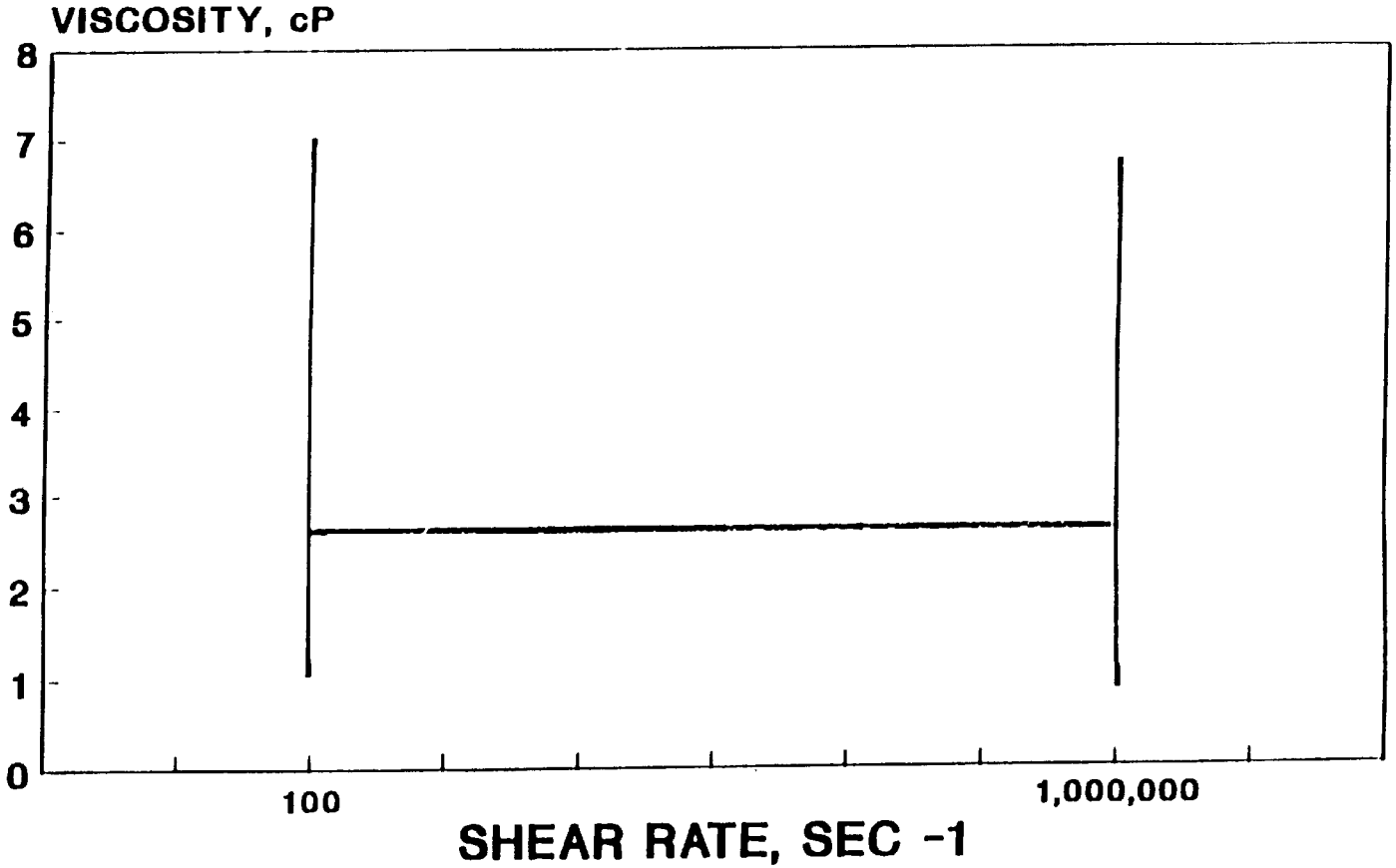
FIG. 1 shows the viscosity loss trapezoid for an ideal, Newtonian fluid.

Lubricating oils contemplated for use as the lubricating oil, or in the blend of lubricating oils of the present this invention are derived from natural lubricating oils. Suitable lubricating oils also include basestocks obtained by isomerization of synthetic wax and slack wax, as well as basestocks produced by hydrocracking (rather than solvent extracting) the aromatic and polar components of a crude. The natural lubricating oil will have a kinematic viscosity (kv), which can be determined in accordance with ASTM D 445 of at least about 3 $mm^2/s$. If the lubricating oil is a blend of oils, the blend (not necessarily each oil) will display the required viscosity characteristics.

Natural lubricating oils include animal oils, vegetable oils (e.g., castor oil and lard oil), petroleum oils, mineral oils, and oils derived from coal or shale. The preferred natural lubricating oil is mineral oil.

The mineral oils useful in this invention include all common mineral oil base stocks. This would include oils that are naphthenic or paraffinic in chemical structure. Oils that are refined by conventional methodology using acid, alkali, and clay or other agents such as aluminum chloride, or they may be extracted oils produced, for example, by solvent extraction with solvents such as phenol, sulfur dioxide, furfural, dichlordiethyl ether, etc. They may be hydrotreated or hydrofined, dewaxed by chilling or catalytic dewaxing processes, or hydrocracked. The mineral oil may be produced from natural crude sources or be composed of isomerized wax materials or residues of other refining processes.

Particularly useful in conjunction with the ATFs of the present invention are mineral oils that are severely hydrotreated or hydrocracked. These processes expose the mineral oil to very high hydrogen pressures at elevated temperatures in the presence of hydrogenation catalysts. In a typical hydrocracking process a mineral oil feedstock is passed over a hydrogenation-type catalyst under a hydrogen pressure of approximately 20,750 kPa (3000 pounds per square inch (psi)), at a temperature ranging from 300 to 450° C. This processing removes sulfur and nitrogen and other impurities from the lubricating oil and fully saturates any alkylene or aromatic structures in the feedstock. The result is a base oil with extremely good oxidation resistance and viscosity index. A secondary benefit of these processes is that low molecular weight consituents of the feedstock, such as waxes, can be isomerized from linear to branched structures thereby providing finished base oils with significantly improved low temperaure properties. These hydrotreated oils may then be further de-waxed either catalytically or by conventional means to provide a basestock with exceptional low temperature fluidity. Commercial examples of lubricating baseoils made by one or more of the aforementioned processes include: Chevron RLOP, Petro-Canada P65, Petro-Canada P100, Yukong, Ltd. Yubase 4, Imperial Oil Canada MXT-5 and Shell XHVI 5.2.

The lubricating oils may be derived from refined, rerefined oils, or mixtures thereof. Unrefined oils are obtained directly from a natural source (e.g., coal, shale, or tar sands bitumen) without further purification or treatment. Examples of unrefined oils include a shale oil obtained directly from a retorting operation or a petroleum oil obtained directly from distillation, each of which may then be used without further treatment. Refined oils are similar to the unrefined oils except that refined oils have been treated in one or more purification steps to improve one or more properties. Suitable purification techniques include distillation, hydrotreating, dewaxing, solvent extraction, acid or base extraction, filtration, and percolation, all of which are known to those skilled in the art. Rerefined oils are obtained by treating used oils in processes similar to those used to obtain the refined oils. These rerefined oils are also known as reclaimed or reprocessed oils and are often additionally processed by techniques for removal of spent additives and oil breakdown products.

Suitable blends of natural oils meeting the criteria of the invention include, for example, a blend of (1) at least one mineral oil having a kinematic viscosity of at least 3.8 $mm^2/s$ at 100° C., and (2) at least one mineral oil with a kinematic viscosity that is less than approximately 3.8 $mm^2/s$ at 100° C. and a viscosity index of greater than 90, as can be determined in accordance with ASTM-D 2270. As noted infra, each oil that constitutes the blend need not have the specified kinematic viscosity. Instead, only the overall blend of natural oils must have a kinematic viscosity of at least 3 $mm^2/s$ at 100° C.

The lubricating oils useful in the practice of the present invention are substantially free (less than 5 wt. %, based on the total weight of lubricating oil), preferably less than about 3 wt. %, most preferably totally free (about 0 wt. %) of synthetic lubricating oils. Synthetic lubricating oils substantially or totally excluded from the compositions of the present invention include hydrocarbon oils and halo-substituted hydrocarbon oils such as oligomerized, polymerized, and interpolymerized (e.g., polybutylenes, polypropylenes, propylene, isobutylene copolymers, chlorinated chlorinated polyactenes, poly(1-hexenes), poly(1-octenes), poly(1-decenes), etc. and mixtures thereof); polyphenyls (e.g., biphenyls, terphenyls, alkylated polyphenyls, etc.); and alkylated diphenyl ethers, alkylated diphenyl sulfides, as well as their derivatives, analogs and homologs thereof.

Also substantially or totally excluded from the compositions of the present invention are synthetic lubricating oils that are alkylene oxide polymers, interpolymers, copolymers and derivatives thereof where the terminal hydroxy groups have been modified by esterification, etherification, etc. This class of excluded synthetic lubricating oils is exemplified by: polyoxyalkylene polymers prepared by polymerization of ethylene oxide or propylene oxide; the alkyl or aryl ethers of these polyoxyalkylene polymers (e.g., methyl-polyisopropylene glycol ether having an average molecular weight of 1000, diphenyl ether of polypropylene glycol having a molecular weight of 1000 to 1500); and mono- and poly-carboxylic esters thereof (e.g., the acetic acid esters, mixed $C_3$–$C_8$ fatty acid esters, and $C_{12}$ oxo acid diester of tetraethylene glycol).

Further substantially or totally excluded from the compositions of the present invention are synthetic lubricating oils that can be classified as esters of dicarboxylic acids (e.g., phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkeny malonic acids, etc.) with an alcohol (e.g., butyl alcohol, hexyl alcohol, dodecyl alcohol, 2-ethylhexyl alcohol, ethylene glycol, diethylene glycol monoethers, propylene glycol, etc.). Specific examples of these excluded esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebasic acid with two moles of tetraethylene glycol and two moles of 2-ethylhexanoic acid, and the like. Esters classified as synthetic oils substantially or totally excluded from the compositions of the present invention also include those made from $C_5$ to $C_{12}$ monocarboxylic acids and polyols and polyol ethers such as neopentyl glycol, trimethylolpropane pentaerythritol, dipentaerythritol, tripentaerythritol, and the like.

Synthetic lubricating oils substantially or totally excluded from the compositions of the present invention also include silicon-based oils (such as polyalkyl-, polyaryl-, polyalkoxy- or polyaryloxy-siloxane oils and silicate oils). Such oils include tetra-ethyl silicate, tetra-isopropyl silicate, tetra-(2-ethylhexyl) silicate, tetra-(4-methyl-2-ethylhexyl) silicate, tetra-(p-tert-butylphenyl) silicate, hexa-(4-methyl-2-pentoxy)-disiloxane, poly(methyl)-siloxanes, and poly (methylphenyl) siloxanes, and the like. Other synthetic lubricating oils substantially or totally excluded from the compositions of the present invention include liquid esters of phosphorous-containing acids (e.g., tricresyl phosphate, trioctyl phosphate and diethyl ester of decylphonic acid), polymeric tetra-hydrofurans, poly-α-olefins, and the like.

Viscosity Modifiers

Suitable viscosity modifiers for use in this invention are those of a relatively specific molecular weight range. While this molecular range may vary according to the particular type of viscosity modifier used, the molecular weight must be no greater than about 175,000 (especially less than 175,000) to achieve the broadest embodiment of this invention, and typically less than 150,000, most preferably from about 75,000 to 150,000 atomic mass units to obtain the viscometric and shear stability requirements of a more restrictive embodiment of this invention. Although there is no precise lower limit on the molecular weight of the viscosity modifier with which the benefits of this invention can be obtained, the molecular weight will typically range from about 30,000, preferably from 50,000, and most preferably from 75,000 to no greater than about 175,000 (especially less than 175,000), preferably no greater than 150,000, atomic mass units. The term "atomic mass unit" is a measure of atomic mass defined as equal to 1/12 the mass of a carbon atom of mass 12.

The term "molecular weight", for the purposes of this invention, refers to the weight average molecular weight measured for example, by gel permeation chromatography. Also, the term molecular weight, for purposes of this invention, is intended to encompass both "actual" and "effective molecular weights". "Actual" refers to when a single viscosity modifier is used—thus, when only one viscosity modifier is employed, the molecular weight is the actual molecular weight of the viscosity modifier.

The term "effective molecular weight" refers to when more than one viscosity modifier is used to achieve this invention's benefits. Effective molecular weight is calculated by summing each individual viscosity modifier's molecular weight contribution, which in turn is determined by multiplying the actual molecular weight of the individual viscosity modifier by its weight fraction in the viscosity modifier mixture.

Suitable viscosity modifiers include hydrocarbyl polymers and polyesters. Examples of suitable hydrocarbyl polymers include homopolymers and copolymers of two or more monomers of $C_2$ to $C_{30}$, e.g., $C_2$ to $C_8$ olefins, including both α-olefins and internal olefins, which may be straight or branched, aliphatic, aromatic, alkyl-aromatic, cycloaliphatic, etc. Frequently they will be of ethylene with $C_3$ to $C_{30}$ olefins, particularly preferred being the copolymers of ethylene and propylene. Other polymers can be used such as polyisobutylenes, homopolymers and copolymers of $C_6$ and higher α-olefins, atactic polypropylene, hydrogenated polymers and copolymers and terpolymers of styrene, e.g., with isoprene and/or butadiene.

More specifically, other hydrocarbyl polymers suitable as viscosity modifiers in this invention include those which may be described as hydrogenated or partially hydrogenated homopolymers, and random, tapered, star, or block interpolymers (including terpolymers, tetrapolymers, etc.) of conjugated dienes and/or monovinyl aromatic compounds with, optionally, α-olefins or lower alkenes, e.g., $C_3$ to $C_{18}$ α-olefins or lower alkenes. The conjugated dienes include isoprene, butadiene, 2,3-dimethylbutadiene, piperylene and/or mixtures thereof, such as isoprene and butadiene. The monovinyl aromatic compounds include vinyl di- or polyaromatic compounds, e.g., vinyl naphthalene, or mixtures of vinyl mono-, di- and/or polyaromatic compounds, but are preferably monovinyl monoaromatic compounds, such as styrene or alkylated styrenes substituted at the α-carbon atoms of the styrene, such as alpha-methylstyrene, or at ring carbons, such as o-, m-, p-methylstyrene, ethylstyrene, propylstyrene, isopropylstyrene, butylstyrene isobutylstyrene, tert-butylstyrene (e.g., p-tert-butylstyrene). Also included are vinylxylenes, methylethylstyrenes and ethylvinylstyrenes. The α-olefins and lower alkenes optionally included in these random, tapered and block copolymers preferably include ethylene, propylene, butene, ethylene-propylene copolymers, isobutylene, and polymers and copolymers thereof. As is also known in the art, these random, tapered and block copolymers may include relatively small amounts, that is less than about 5 mole %, of other copolymerizable monomers such as vinyl pyridines, vinyl lactams, methacrylates, vinyl chloride, vinylidene chloride, vinyl acetate, vinyl stearate, and the like.

Specific examples include random polymers of butadiene and/or isoprene and polymers of isoprene and/or butadiene and styrene. Typical block copolymers include polystyrene-polyisoprene, polystyrene-polybutadiene, polystyrene-polyethylene, polystyrene-ethylene propylene copolymer, polyvinyl cyclohexane-hydrogenated polyisoprene, and polyvinyl cyclohexane-hydrogenated polybutadiene. Tapered polymers include those of the foregoing monomers prepared by methods known in the art. Star-shaped polymers typically comprise a nucleus and polymeric arms linked to said nucleus, the arms being comprised of homopolymer or interpolymer of said conjugated diene and/or monovinyl aromatic monomers. Typically, at least about 80% of the aliphatic unsaturation and about 20% of the aromatic unsaturation of the star-shaped polymer is reduced by hydrogenation.

Representative examples of patents which disclose such hydrogenated polymers or interpolymers include U.S. Pat. Nos. 3,312,621, 3,318,813, 3,630,905, 3,668,125, 3,763,044, 3,795,615, 3,835,053, 3,838,049, 3,965,019, 4,358,565, and 4,557,849.

Suitable hydrocarbyl polymers are ethylene copolymers containing from 15 to 90 wt % ethylene, preferably 30 to 80 wt. % of ethylene and 10 to 85 wt. %, preferably 20 to 70 wt. % of one or more $C_3$ to $C_{28}$, preferably $C_3$ to $C_{18}$, more preferably $C_3$ to $C_8$, α-olefins. While not essential, such copolymers preferably have a degree of crystallinity of less than 25 wt. %, as determined by X-ray and differential scanning calorimetry. Copolymers of ethylene and propylene are most preferred. Other α-olefins suitable in place of propylene to form the copolymer, or to be used in combination with ethylene and propylene, to form a terpolymer, tetrapolymer, etc., include 1-butene, 1-pentene, 1-hexene, 1-heptene, 1-octene, 1-nonene, 1-decene, etc.; also branched chain α-olefins, such as 4-methyl-1-pentene, 4-methyl-1-hexene, 5-methylpentene-1, 4,4-dimethyl-1-pentene, and 6-methyl-heptene-1, etc., and mixtures thereof.

Terpolymers, tetrapolymers, etc., of ethylene, said $C_3$ to $C_{28}$ α-olefin, and non-conjugated diolefin or mixtures of such diolefins may also be used. The amount of the non-conjugated diolefin generally ranges from about 0.5 to 20 mole percent, preferably from about 1 to about 7 mole percent, based on the total amount of ethylene and α-olefin present.

The preferred viscosity modifiers are polyesters, most preferably polyesters of ethylenically unsaturated $C_3$ to $C_8$ mono- and dicarboxylic acids such as methacrylic and acrylic acids, maleic acid, maleic anhydride, fumaric acid, etc.

Examples of unsaturated esters that may be used include those of aliphatic saturated mono alcohols of at least 1 carbon atom and preferably of from 12 to 20 carbon atoms, such as decyl acrylate, lauryl methacrylate, cetyl methacrylate, stearyl methacrylate, and the like and mixtures thereof.

Other esters include the vinyl alcohol esters of $C_2$ to $C_{22}$ fatty or monocarboxylic acids, preferably saturated such as vinyl acetate, vinyl laurate, vinyl palmitate, vinyl stearate, vinyl oleate, and the like and mixtures thereof. Copolymers of vinyl alcohol esters with unsaturated acid esters such as the copolymer of vinyl acetate with dialkyl fumarates, can also be used.

The esters may be copolymerized with still other unsaturated monomers such as olefins, e.g., 0.2 to 5 moles of $C_2$–$C_{20}$ aliphatic or aromatic olefin per mole of unsaturated ester, or per mole of unsaturated acid or anhydride followed by esterification. For example, copolymers of styrene with maleic anhydride esterified with alcohols and amines are known, e.g., see U.S. Pat. No. 3,702,300.

Such ester polymers may be grafted with, or the ester copolymerized with, polymerizable unsaturated nitrogen-containing monomers to impart dispersancy to the viscosity modifiers. Examples of suitable unsaturated nitrogen-containing monomers to impart dispersancy include those containing 4 to 20 carbon atoms such as amino substituted olefins as p-(beta-diethylaminoethyl)styrene; basic nitrogen-containing heterocycles carrying a polymerizable ethylenically unsaturated substituent, e.g. the vinyl pyridines and the vinyl alkyl pyridines such as 2-vinyl-5-ethyl pyridine, 2-methyl-5-vinyl pyridine, 2-vinyl-pyridine, 3-vinyl-pyridine, 4-vinyl-pyridine, 3-methyl-5-vinyl-pyridine, 4-methyl-2-vinyl-pyridine, 4-ethyl-2-vinyl-pyridine and 2-butyl-5-vinyl-pyridine and the like.

N-vinyl lactams are also suitable, e.g. N-vinyl pyrrolidones or N-vinyl piperidones.

The vinyl pyrrolidones are preferred and are exemplified by N-vinyl pyrrolidone, N-(1-methyl-vinyl) pyrrolidone, N-vinyl-5-methyl pyrrolidone, N-vinyl-3,3-dimethylpyrrolidone, N-vinyl-5-ethyl pyrrolidone, etc.

Typically, the selected viscosity modifier will be present in a finished ATF composition in an amount between 2 and 20 wt. %, preferably between 4 and 10 wt. %, especially when the viscosity modifier is a polymethacrylate, the preferred viscosity modifier. The above-noted weights are of commercially available solutions of active polymer in diluent. In such commercial products the concentration of active polymer is typically 25 wt. % to 75 wt. %, based on the total combined weight of polymer and diluent. The precise amount of viscosity modifier is not critical to the present invention as long as the resulting ATF provides the required viscometric properties, described infra.

Friction Modifiers

A wide variety of friction modifiers may be employed in the present invention including the following:

(i) Alkoxylated Amines

Alkoxylated amines are a particularly suitable type of friction modifier for use in this invention. These types of friction modifiers may be selected from the group consisting of (I), (II), and mixtures thereof, where (I) and (II) are:

(I)

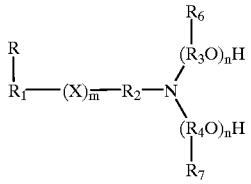

(II)

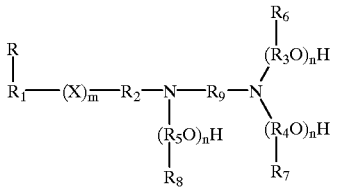

and where

R is H or $CH_3$;

$R_1$ is a $C_8$–$C_{28}$ saturated or unsaturated, substituted or unsubstituted, aliphatic hydrocarbyl radical, preferably $C_{10}$–$C_{20}$, most preferably $C_{14}$–$C_{18}$;

$R_2$ is a straight or branched chain $C_1$–$C_6$ alkylene radical, preferably $C_2$–$C_3$;

$R_3$, $R_4$, and $R_5$ are independently the same or different, straight or branched chain $C_2$–$C_5$ alkylene radical, preferably $C_2$–$C_4$;

$R_6$, $R_7$, and $R_8$ are independently H or $CH_3$;

$R_9$ is a straight or branched chain $C_1$–$C_5$ alkylene radical, preferably $C_2$–$C_3$;

X is oxygen or sulfur, preferably oxygen; m is 0 or 1, preferably 1; and n is an integer, independently 1–4, preferably 1.

In a particularly preferred embodiment, this type of friction modifier is characterized by formula (I) where X represents oxygen, R and $R_1$ contain a combined total of 18 carbon atoms, $R_2$ represents a $C_3$ alkylene radical, $R_3$ and $R_4$ represent $C_2$ alkylene radicals, $R_6$ and $R_7$ are hydrogens, m is 1, and each n is 1. Preferred amine compounds contain a combined total of from about 18 to about 30 carbon atoms.

Preparation of the amine compounds, when X is oxygen and m is 1, is, for example, by a multi-step process where an alkanol is first reacted, in the presence of a catalyst, with an unsaturated nitrile such as acrylonitrile to form an ether nitrile intermediate. The intermediate is then hydrogenated, preferably in the presence of a conventional hydrogenation catalyst, such as platinum black or Raney nickel, to form an ether amine. The ether amine is then reacted with an alkylene oxide, such as ethylene oxide, in the presence of an alkaline catalyst by a conventional method at a temperature in the range of about 90–150° C.

Another method of preparing the amine compounds, when X is oxygen and m is 1, is to react a fatty acid with ammonia or an alkanol amine, such as ethanolamine, to form an intermediate which can be further oxyalkylated by reaction with an alkylene oxide, such as ethylene oxide or propylene oxide. A process of this type is discussed in, for example, U.S. Pat. No. 4,201,684.

When X is sulfur and m is 1, the amine friction modifying compounds can be formed, for example, by effecting a conventional free radical reaction between a long chain alpha-olefin with a hydroxyalkyl mercaptan, such as beta-hydroxyethyl mercaptan, to produce a long chain alkyl hydroxyalkyl sulfide. The long chain alkyl hydroxyalkyl sulfide is then mixed with thionyl chloride at a low temperature and then heated to about 40° C. to form a long chain alkyl chloroalkyl sulfide. The long chain alkyl chloroalkyl sulfide is then caused to react with a dialkanolamine, such as diethanolamine, and, if desired, with an alkylene oxide, such as ethylene oxide, in the presence of an alkaline catalyst and at a temperature near 100° C. to form the desired amine compounds. Processes of this type are known in the art and are discussed in, for example, U.S. Pat. No. 3,705,139.

In cases when X is oxygen and m is 1, the present amine friction modifiers are well known in the art and are described in, for example, U.S. Pat. Nos. 3,186,946, 4,170,560, 4,231,883, 4,409,000 and 3,711,406.

Examples of suitable amine compounds include, but are not limited to, the following:

N,N-bis(2-hydroxyethyl)-n-dodecylamine;
N,N-bis(2-hydroxyethyl)-1-methyl-tridecenylamine;
N,N-bis(2-hydroxyethyl)-hexadecylamine;
N,N-bis(2-hydroxyethyl)-octadecylamine;
N,N-bis(2-hydroxyethyl)-octadecenylamine;
N,N-bis(2-hydroxyethyl)-oleylamine;
N,N-bis(2-hydroxyethyl)-stearylamine;
N,N-bis(2-hydroxyethyl)-undecylamine;
N-(2-hydroxyethyl)-N-(hydroxyethoxyethyl)-n-dodecylamine;
N,N-bis(2-hydroxyethyl)-1-methyl-undecylamine;
N,N-bis(2-hydroxyethoxyethoxyethyl)-1-ethyl-octadecylamine;
N,N-bis(2-hydroxyethyl)-cocoamine;
N,N-bis(2-hydroxyethyl)-tallowamine;
N,N-bis(2-hydroxyethyl)-n-dodecyloxyethylamine;
N,N-bis(2-hydroxyethyl)-lauryloxyethylamine;
N,N-bis(2-hydroxyethyl)-stearyloxyethylamine;
N,N-bis(2-hydroxyethyl)-dodecylthioethylamine;
N,N-bis(2-hydroxyethyl)-dodecylthiopropylamine;
N,N-bis(2-hydroxyethyl)-hexadecyloxypropylamine;
N,N-bis(2-hydroxyethyl)-hexadecylthiopropylamine;
N-2-hydroxyethyl,N-[N',N'-bis(2-hydroxyethyl) ethylamine]-octadecylamine; and
N-2-hydroxyethyl,N-[N',N'-bis(2-hydroxyethyl) ethylamine]-stearylamine.

The most preferred additive is N,N-bis(2-hydroxyethyl)-hexadecyloxypropylamine. This additive is available from Tomah Company under the designation Tomah E-22-S-2.

The amine's hydrocarbyl chain length, the saturation of the hydrocarbyl chain, and the length and position of the polyoxyalkylene chains can be varied to suit specific requirements. For example, increasing the number of carbon atoms in the hydrocarbyl radical tends to increase the amine's melting temperature and oil solubility, however, if the hydrocarbyl radical is too long, the amine will crystallize from solution. Decreasing the degree of saturation in the hydrocarbyl radical, at the same carbon content of the hydrocarbyl chain, tends to reduce the melting point of the amine. Increasing the amount of alkylene oxide, to lengthen the polyoxyalkylene chains, tends to increase the amine's water solubility and decrease its oil solubility.

The amine compounds may be used as such. However, they may also be used in the form of an adduct or reaction product with a boron compound, such as a boric oxide, a boron halide, a metaborate, boric acid, or a mono-, di-, and trialkyl borate. Such adducts or derivatives may be illustrated, for example, by the following structural formula:

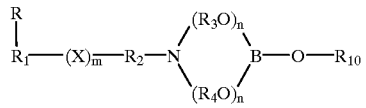

where R, $R_1$, $R_2$, $R_3$, $R_4$, X, m, and n are the same as previously defined and where $R_{10}$ is either hydrogen or an alkyl radical.

(ii) Carboxylic Acids/Anhydrides with Polyamines

A second type of friction modifier useful with this invention is the reaction product of a polyamine and a carboxylic acid or anhydride. Briefly, the polyamine reactant contains from 2 to 60 total carbon atoms and from 3 to 15 nitrogen atoms with at least one of the nitrogen atoms present in the form of a primary amine group and at least two of the remaining nitrogen atoms present in the form of primary or secondary amine groups. Non-limiting examples of suitable amine compounds include: polyethylene amines such as diethylene triamine (DETA); triethylene tetramine (TETA); tetraethylene pentamine (TEPA); polypropylene amines such as di-(1,2-propylene)triamine, di(1,3-propylene) triamine, and mixtures thereof. Additional suitable amines include polyoxyalkylene polyamines such as polyoxypropylene triamines and polyoxyethylene triamines. Preferred amines include DETA, TETA, TEPA, and mixtures thereof (PAM). The most preferred amines are TETA, TEPA, and PAM.

The carboxylic acid or anhydride reactant of the above reaction product is characterized by formula (III),(IV),(V), (VI), and mixtures thereof:

(III)

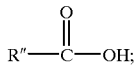

(IV)

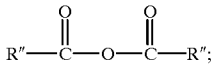

(V)

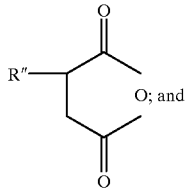

(VI)

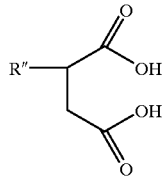

where R" is a straight or branched chain, saturated or unsaturated, aliphatic hydrocarbyl radical containing from 9 to 29 carbon atoms, preferably from 11 to 23. When R" is a branched chain group, no more than 25% of the carbon atoms are in side chain or pendent groups. R" is preferably straight chained.

The R" hydrocarbyl group includes predominantly hydrocarbyl groups as well as purely hydrocarbyl groups. The description of these groups as predominantly hydrocarbyl means that they contain no non-hydrocarbyl substituents or non-carbon atoms that significantly affect the hydrocarbyl characteristics or properties of such groups relevant to their uses as described here. For example, a purely hydrocarbyl $C_{20}$ alkyl group and a $C_{20}$ alkyl group substituted with a methoxy substituent are substantially similar in their properties and would be considered hydrocarbyl within the context of this disclosure.

Non-limiting examples of substituents that do not significantly alter the hydrocarbyl characteristics or properties of the general nature of the hydrocarbyl groups of the carboxylic acid or anhydride are:

Ether groups (especially hydrocarbyloxy such as phenoxy, benzyloxy, methoxy, n-isotoxy, etc., particularly alkoxy groups of up to ten carbon atoms);

Oxo groups (e.g., —O— linkages in the main carbon chair

Ester groups (e.g., —C(=O)—O— hydrocarbyl);

Sulfonyl groups (e.g., —S(=O)(=O)— hydrocarbyl); and

Sulfinyl groups (e.g., —S(=O)— hydrocarbyl).

These types of friction modifiers can be formed by reacting, at a temperature from about 120 to 250° C., at least one polyamine and one carboxylic acid or anhydride in proportions of about 2 to 10 molar equivalents of carboxylic acid or anhydride per mole of amine reactant.

(iii) Other Friction Modifiers

Optionally, other friction modifiers may be used either alone or in combination with the foregoing described friction modifiers to achieve the desired fluid performance. Among these are esters of carboxylic acids and anhydrides with alkanols. Other conventional friction modifiers generally consist of a polar terminal group (carboxyl, hydroxyl, amino, etc.) covalently bonded to an oleophilic hydrocarbon chain.

Particularly preferred esters of carboxylic acids and anhydrides with alkanols are described in, for example, U.S. Pat. No. 4,702,850. This reference teaches the usefulness of these esters as friction modifiers, particularly the esters of succinic acids or anhydrides with thio-bis-alkanols, most particularly with esters of 2-octadecenyl succinic anhydride and thiodiglycol.

Examples of other conventional friction modifiers (i.e., polar terminal group+oleophilic hydrocarbon chain) are described by, for example, M. Belzer in the "Journal of Tribology" (1992), Vol. 114, pp. 675–682 and M. Belzer and S. Jahanmir in "Lubrication Science" (1988), Vol. 1, pp. 3–26.

Typically the friction modifiers will be present in finished ATF composition in an amount between 0.01 to 5, preferably 0.1 to 3 wt. %.

Seal Swell Agents

ATFs may optionally contain seal swell agents such as alcohols, alkylbenzenes, substituted sulfolanes or mineral oils that cause swelling of elastomeric materials. Alcohol-type seal swell agents are low volatility linear alkyl alcohols. Examples of suitable alcohols include decyl alcohol, tridecyl alcohol and tetradecyl alcohol. Examples of alkylbenzenes useful as seal swell agents for use in conjunction with the compositions of the present invention include dodecylbenzenes, tetradecylbenzenes, dinonyl-benzenes, di(2-ethylhexyl)benzene, and the like. Examples of substituted sulfolanes are described in U.S. Pat. No. 4,029,588, incorporated herein by reference for purposes of U.S. patent practice. Mineral oils useful as seal swell agents are typically low viscosity mineral oils with high naphthenic or aromatic content. Examples of suitable mineral oil seal swell agents include Exxon Necton-37 (FN 1380) and Exxon Mineral Seal Oil (FN 3200). When used in the ATF of the present invention, a seal swell agent will typically comprise from about 1 to about 30 wt. %, preferably from about 2 to about 20 wt. %, most preferably from about 5 to about 15 wt. %, based on the total weight of ATF.

Other additives known in the art may also be added to the ATF. These additives include, but are not limited to, dispersants, antiwear agents, antioxidants, corrosion inhibitors, detergents, extreme pressure additives, and the like. They are generally disclosed in, for example, "Lubricant Additives" by C. V. Smalheer and R. Kennedy Smith, 1967, pp. 1–11 and U.S. Pat. Nos. 5,389,273; 5,326,487; 5,314,633; 5,256,324; 5,242,612; 5,198,133; 5,185,090; 5,164,103; 4,855,074; and 4,105,571.

Representative amounts of these additives are summarized as follows:

| Additive | (Broad) Wt. % | (Preferred) Wt. % |
|---|---|---|
| Corrosion Inhibitor | 0.01–3 | 0.02–1 |
| Antioxidants | 0.01–5 | 0.2–3 |
| Dispersants | 0.10–10 | 2–5 |
| Antifoaming Agents | 0.001–5 | 0.001–0.5 |
| Detergents | 0.01–6 | 0.01–3 |
| Antiwear Agents | 0.001–5 | 0.2–3 |
| Seal Swellants | 0.1–8 | 0.5–5 |
| Pour Point Depressants | 0.01–2 | 0.01–1.5 |

Suitable dispersants include hydrocarbyl succinimides, hydrocarbyl succinamides, mixed ester/amides of hydrocarbyl-substituted succinic acid, hydroxyesters of hydrocarbyl-substituted succinic acid, and Mannich condensation products of hydrocarbyl-substituted phenols, formaldehyde and polyamines. Mixtures of such dispersants can also be used.

The preferred dispersants are the alkenyl succinimides. These include acyclic hydrocarbyl substituted succinimides formed with various amines or amine derivatives such as are widely disclosed in the patent literature. Use of alkenyl succinimides which have been treated with an inorganic acid of phosphorus (or an anhydride thereof) and a boronating agent are also suitable for use in the compositions of this invention as they are much more compatible with elastomeric seals made from such substances as fluoro-elastomers and silicon-containing elastomers. Polyisobutenyl succinimides formed from polyisobutenyl succinic anhydride and an alkylene polyamine such as triethylene tetramine or tetraethylene pentamine wherein the polyisobutenyl substituent is derived from polyisobutene having a number average molecular weight in the range of 500 to 5000 (preferably 800 to 2500) are particularly suitable. Dispersants may be post-treated with many reagents known to those skilled in the art. (see, e.g., U.S. Pat. Nos. 3,254,025, 3,502,677 and 4,857,214).

Suitable antioxidants are amine-type and phenolic antioxidants. Examples of the amine-type antioxidants include phenyl alpha naphthylamine, phenyl beta naphthylamine, diphenylamine, bis- alkylated diphenyl amines (e.g., p,p'-bis(alkylphenyl)amines wherein the alkyl groups contain from 8 to 12 carbon atoms each). Phenolic antioxidants include sterically hindered phenols (e.g., 2,6-di-tert-butylphenol, 4-methyl-2,6-di-tert-butylphenol, etc.) and bisphenols (e.g., 4,4'-methylenebis(2,6-di-tert-butylphenol), etc.) and the like.

Additive concentrates of this invention will contain the viscosity modifier, friction modifier, and other desired additives in a natural and/or synthetic lubricating oil, in relative proportions such that by adding the concentrate to a larger amount of a suitable natural and/or synthetic oil the resulting fluid will contain each of the ingredients in the desired concentration. Thus, the concentrate may contain a synthetic oil as the lubricating oil if the desired final composition contains less than 5 wt. % of synthetic oil relative to the total amount of oil (mineral oil and synthetic oil). The concentrate typically will contain between 25 to 100, preferably from 65 to 95, most preferably from 75 to 90 weight percent of the viscosity modifier, friction modifier, other desired additives, and synthetic and/or natural oil.

Viscometric Properties

A common method of characterizing the viscometric behavior of lubricants relative to high temperature viscosity at both high and low shear rates, and the ability of the fluid to retain these viscometrics after use, is called the 'Viscosity Loss Trapezoid'. The viscosity loss trapezoid is developed by measuring the viscosity of the fluid under a variety of conditions both "new" (i.e., fresh or unused) and "sheared" (i.e., used). The "sheared" fluid is produced by passing it through a fuel injector shear tester forty times (ASTM D 5275). The measurements required to construct a 'Viscosity Loss Trapezoid' and some of the presently desired minimum values for the more restrictive embodiment of this invention are shown below:

TABLE 1

VISCOSITY LOSS TRAPEZOID

| | SHEAR RATE (Type) | NEW | SHEARED |
|---|---|---|---|
| Fluid Viscosity (150° C.), cP | $2 \times 10^2$ sec.$^{-1}$ (Low) | ≧2.60 | ≧2.60 |
| Fluid Viscosity (150° C.), cP | $1 \times 10^6$ sec.$^{-1}$ (High)* | ≧2.60 | ≧2.60 |

*determined in accordance with ASTM D 4683

Figure 2:
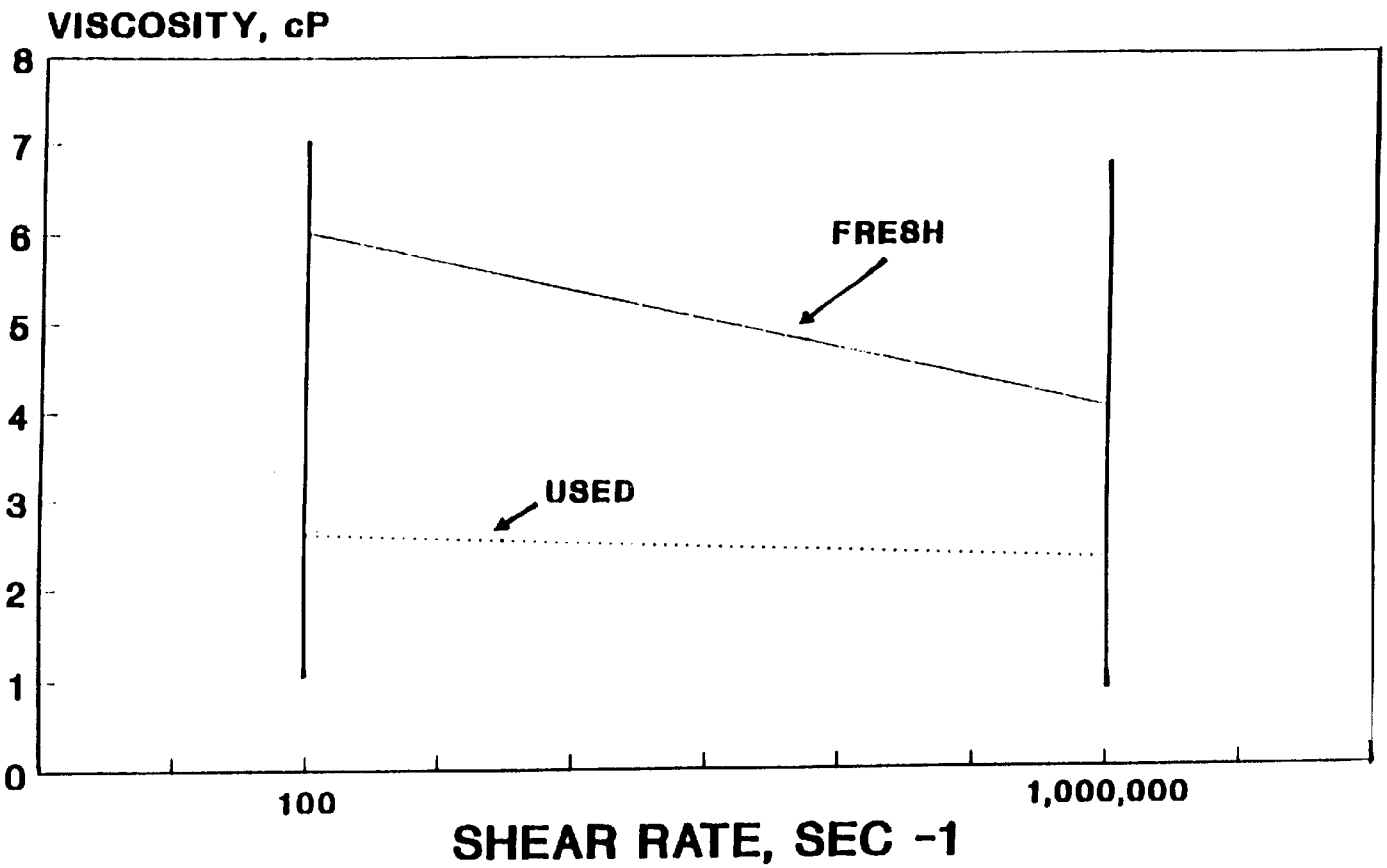
FIG. 2 shows a typical viscosity loss trapezoid for a non-Newtonian fluid.

The viscosity loss trapezoid is then constructed graphically by plotting the four measurements shown above against shear rate. FIGS. 1 and 2 show the types of phenomena that are observed in this testing. FIG. 1 shows a fluid which meets the requirements shown above, it is Newtonian in nature, that is, its viscosity is not dependent on shear stress and is not reduced by mechanical shearing. FIG. 2 shows a fluid that is non-Newtonian, i.e., its viscosity is dependent on shear rate (known as temporary shear) as is indicated by the decreasing viscosity when going from 200 sec.$^{-1}$ to $1\times10^6$ sec.$^{-1}$ shear rates. This fluid also loses viscosity when subjected to mechanical stress (known as permanent shear which is evidenced by the overall loss in viscosity between the fresh and used oil lines).

Additionally, the kinematic viscosity of the more restrictive embodiment measured at 100° C., before and after shearing is desired to be at least 6.8 mm$^2$/s (cSt). That is, the "new" and "sheared" fluid must have a minimum viscosity at 100° C. of at least 6.8 mm$^2$/s (cSt).

Also, since improved operation of vehicles at low ambient temperatures is an objective, it is desirable that the Brookfield viscosity at −40° C. not be greater than about 18,000 cP, preferably not greater than about 15,000 cP (determined in accordance with ASTM D 2983), for all embodiments of this invention.

Furthermore, since seal leakage is more of a concern when dealing with less viscous materials (due to the low −40° C. Brookfield requirement), it is necessary for all embodiments of this invention to have a difference between the "new" and "sheared" viscosities measured at 150° C. and the low shear rate of $2\times10^2$ sec.$^{-1}$ of no greater than about 0.30 cP.

This invention may be further understood by the following examples which are illustrative and not restrictive for this invention.

EXAMPLES

Three ATF fluid formulations were blended to meet the required viscometric properties described above. Fluid Formulations 1 through 3 were each formed with blends of mineral oils using the same basic additive package which contained ashless dispersant, anti-oxidant, extreme pressure agent, corrosion inhibitor and friction modifiers.

The viscosities of the mineral lubricating oils used to form Fluid Formulations 1 through 3 are summarized below.

| Oil | VI | Kinematic Viscosity (mm$^2$/s) at 100° C. |
|---|---|---|
| Exxon Solvent 75 Neutral | 100 | ~3.1 |
| Exxon Solvent 100 Neutral | 100 | ~4.0 |
| Imperial Oil MXT-5 | 105 | ~3.9 |
| Petro-Canada 65P | 95 | ~2.5 |
| Petro-Canada 100P | 110 | ~4.0 |

Each of the Formulations contained a blend of viscosity modifiers, specifically, polymethacrylate viscosity modifiers having molecular weights of 75,000 and 140,000.

The compositions of these Fluid Formulations are shown in Table 1, along with relevant test results. The results shown in Table 2 indicate that Fluid Formulations 1 through 3 using viscosity modifiers of an appropriate molecular weight (no greater than about 175,000 amu) have a −40° C. Brookfield viscosity of no greater than 18,000, and a difference between the new and sheared viscosity of less than 0.30 centipoise (cP). Also, both the new and sheared composition had a viscosity greater than 2.6 cP at 150° C. when measured at shear rates $2\times10^2$ sec.$^{-1}$ and $1\times10^6$ sec.$^{-1}$ and a kinematic viscosity greater than 6.8 mm$^2$/sec.

TABLE 2

Test Results

| | FLUID FORMULATION | | |
|---|---|---|---|
| | 1 | 2 | 3 |
| Base Additive Package* | 10.60 | 10.60 | 10.60 |
| Viscoplex 5061 (MW 140,000) | 4.89 | 4.80 | 4.44 |
| Viscoplex 8-220 (MW 75,000) | 6.11 | 6.00 | 5.56 |
| Exxon Solvent 75 Neutral | 24.25 | — | — |
| Exxon Solvent 100 Neutral | 24.25 | — | — |

TABLE 2-continued

| Test Results | FLUID FORMULATION 1 | 2 | 3 |
|---|---|---|---|
| Imperial Oil MXT-5 | — | 51.20 | — |
| Petro-Canada 65P | 30.00 | 30.00 | 30.00 |
| Petro-Canada 100P | — | — | 52.00 |
| TEST RESULTS | | | |
| New Fluid | | | |
| Kinematic Viscosity @ 100° C., $mm^2/sec$ | 7.90 | 7.90 | 8.00 |
| Brookfield Viscosity @ −40° C., cP | 12,400 | 11,400 | 9,680 |
| Viscosity @ 150° C., $2 \times 10^2$ $sec^{-1}$, cP | 2.96 | 2.96 | 3.00 |
| Viscosity @ 150° C., $1 \times 10^6$ $sec^{-1}$, cP | 2.83 | 2.79 | 2.76 |
| Used Fluid | | | |
| Kinematic Viscosity @ 100° C., $mm^2/sec$ | 7.40 | 7.50 | 7.46 |
| Viscosity @ 150° C., $2 \times 10^2$ $sec^{-1}$, cP | 2.76 | 2.73 | 2.82 |
| Viscosity @ 150° C., $1 \times 10^6$ $sec^{-1}$, cP | 2.72 | 2.73 | 2.69 |

*base additive package contained a friction modifier in an amount sufficient to provide a finished ATF with a friction modifier content of 0.27 wt. %.

The principles, preferred embodiments, and modes of operation of the present invention have been described in the foregoing specification. However, the invention which is intended to be protected herein is not to be construed as limited to the particular forms disclosed, since these are to be regarded as illustrative rather than restrictive. Variations and changes may be made by those skilled in the art without departing from the spirit of the invention.

What is claimed is:

1. An automatic transmission fluid composition comprising:

(a) a natural lubricating mineral oil free of synthetic oils comprising a blend of natural lubricating mineral oils having a kinematic viscosity greater than about 3 $mm^2/s$ at 100° C., wherein said blend of natural lubricating mineral oils comprises:

at least one first natural mineral oil having a viscosity of at least 3.8 $mm^2/s$ at 100° C.; and at least one second natural mineral oil having a viscosity of less than 3.8 $mm^2/s$ at 100° C. and a viscosity index of at least about 90;

(b) a plurality of viscosity modifiers having an effective molecular weight from about 50,000 to no greater than about 175,000 atomic mass units; and (c) from about 0.01 to about 5 weight % of a friction modifier; provided that said composition has a −40° C. Brookfield viscosity no greater than about 18,000 centipoise and the difference between the new and sheared viscosity of the composition is no greater than about 0.30 centipoise when measured at a temperature of 150° C. and a shear rate of $2 \times 10^2$ $sec.^{-1}$.

2. The composition of claim 1, wherein said second mineral oil is a hydrocracked mineral oil.

3. The composition of claim 1, wherein the Brookfield viscosity of said composition is no greater than about 15,000 centipoise.

4. The composition of claim 1 wherein the effective molecular weight of the viscosity modifiers is no greater than about 150,000.

5. The composition of claim 4, wherein the viscosity modifiers are polymethacrylates.

6. The composition of claim 1, wherein the friction modifier is selected from the group consisting of (I);(II); reaction products of polyamines with (III),(IV),(V),(VI); and mixtures thereof, where (I),(II),(III),(IV),(V),(VI) are:

(I)

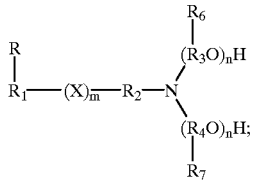

(II)

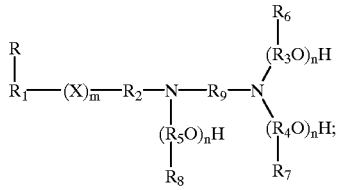

(III)

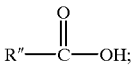

(IV)

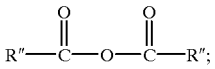

(V)

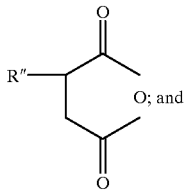

(VI)

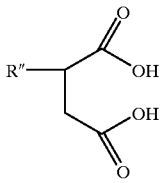

where:

R is H or $CH_3$;

$R_1$ is a $C_8$–$C_{28}$ saturated or unsaturated, substituted or unsubstituted, aliphatic hydrocarbyl radical;

$R_2$ is a straight or branched chain $C_1$–$C_6$ alkylene radical;

$R_3$, $R_4$, and $R_5$ are independently the same or different, straight or branched chain $C_2$–$C_5$ alkylene radical;

$R_6$, $R_7$, and $R_8$ are independently H or $CH_3$;

$R_9$ is a straight or branched chain $C_1$–$C_5$ alkylene radical;

X is oxygen or sulfur;

m is 0 or 1;

n is an integer, independently 1–4; and

R" is a straight or branched chain, saturated or unsaturated, aliphatic hydrocarbyl radical containing from 9 to 29 carbon atoms with the proviso that when R" is a branched chain group, no more than 25% of the carbon atoms are in side chain or pendent groups.

7. The composition of claim 6, wherein the friction modifier is an ethoxylated amine, alkyl amide, or mixtures thereof.

8. The composition of claim 7, wherein the composition further comprises a borated or non-borated succinimide dispersant, a phenolic or amine antioxidant, such that the sum of the dispersant, antioxidant, and friction modifier is between about 2.0 and about 11 weight percent of the composition.

9. The composition of claim 1, wherein the composition has new and sheared viscosities of at least about 6.8 $mm^2/s$ at 100° C.

10. The composition of claim 1, wherein the composition has new viscosity of at least about 6.8 $mm^2/s$ at 100° C. and a sheared viscosity of at least about 2.6 cP at 150° C. for shearing rates up to $1\times10^6$ $sec.^{-1}$.

11. The composition of claim 1, further comprising a seal swell agent.

12. A method for producing the composition of claim 1, comprising the steps of:

(a) providing the natural lubricating mineral oil free of synthetic oils; and (b) adding to the lubricating oil the viscosity modifiers and about 0.01 to about 5.0 weight % of the friction modifier.

13. The composition of claim 1, wherein said composition comprises two viscosity modifiers.

* * * * *